US006638476B1

(12) United States Patent
Elias et al.

(10) Patent No.: US 6,638,476 B1
(45) Date of Patent: Oct. 28, 2003

(54) PACKAGING MATERIAL STERILIZING UNIT FOR A POURABLE FOOD PRODUCT PACKAGING MACHINE

(75) Inventors: Detlef Elias, Formigine (IT); Paolo Benedetti, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/622,208

(22) PCT Filed: Jun. 28, 1999

(86) PCT No.: PCT/EP99/04460

§ 371 (c)(1),
(2), (4) Date: Aug. 14, 2000

(87) PCT Pub. No.: WO00/00393

PCT Pub. Date: Jan. 6, 2000

(30) Foreign Application Priority Data

Jun. 30, 1998 (EP) ..... 98830392

(51) Int. Cl.[7] ..... A61L 9/00; A61L 2/00; B08B 3/00; B65B 55/02; F26B 7/00

(52) U.S. Cl. ..... 422/28; 422/31; 422/32; 422/34; 422/300; 422/301; 134/107; 53/425; 53/426; 53/523; 53/561; 34/306; 34/329; 34/337; 34/370

(58) Field of Search ..... 422/1, 26–28, 422/31–32, 38, 114, 244, 292–293, 297, 299, 300–301, 302, 309, 905; 134/107; 53/425–426, 523, 561; 34/306, 329–331, 337–340, 370–374

(56) References Cited

U.S. PATENT DOCUMENTS

| | | | | |
|---|---|---|---|---|
| 3,692,468 A | * | 9/1972 | Loliger et al. | 21/58 |
| 3,884,012 A | | 5/1975 | Ernstsson et al. | 53/22 A |
| 3,891,779 A | * | 6/1975 | Robinson | 426/399 |
| 3,911,640 A | | 10/1975 | Rausing | 53/21 FC |
| 4,127,384 A | * | 11/1978 | Fahlvik et al. | 422/109 |
| 5,262,126 A | * | 11/1993 | Shimamura et al. | 422/28 |
| 5,569,438 A | | 10/1996 | Hilmersson | 422/293 |
| 5,900,111 A | | 5/1999 | Nyström et al. | 162/6 |

* cited by examiner

*Primary Examiner*—Robert J. Warden, Sr.
*Assistant Examiner*—Monzer R. Chorbaji
(74) *Attorney, Agent, or Firm*—Burns, Doane, Swecker & Mathis, L.L.P.

(57) ABSTRACT

A unit for sterilizing strip packaging material for a pourable food product packaging machine, and having a sterilizing chamber for containing a liquid sterilizing agent and along which the packaging material is fed; a control circuit for controlling the sterilizing agent, and in turn having a collecting tank, input means for feeding the sterilizing agent from the tank to the chamber, and a drain assembly for draining the sterilizing agent from the chamber into the tank; a control system for controlling the temperature in the chamber; and preheating system for preheating the sterilizing agent in the tank, and which may be activated prior to feeding the sterilizing agent from the tank into the chamber; the preheating system for preheating the sterilizing agent may be activated independently of the control system for controlling the temperature in the chamber to bring the sterilizing agent to a temperature at least equal to that of the chamber before the sterilizing agent is fed into the chamber.

18 Claims, 2 Drawing Sheets

7
2
6
49
50
57
46
48
56
35
21
20
5
4
47
51
3
P
27a
52
26
30
31
43
32
40
41
42
55
27b
65
44
45
33
29
62
63
36
59
60
64
25
34
58
16
37
8
61
5
12
28
18
17
14
10
1
11
15
66
13

7
2
6
21
71
1'
48
46
50
49
5
4
P
3
70
70
47
51
57
56
52
55
12
16
8
5
17
18
10
14
15
11
13
66

PACKAGING MATERIAL STERILIZING UNIT FOR A POURABLE FOOD PRODUCT PACKAGING MACHINE

TECHNICAL FIELD

The present invention relates to a sterilizing unit for a pourable food product packaging machine.

BACKGROUND OF THE INVENTION

Machines for packaging pourable food products, such as fruit juice, wine, tomato sauce, pasteurized or preserved (UHT) milk, etc., are known in which the packages are formed from a continuous tube of packaging material defined by a longitudinally sealed strip.

The packaging material has a multilayer structure comprising a layer of paper material coated on both sides with layers of heat-seal material, e.g. polyethylene. For aseptic packaging of preserved products such as UHT milk, the packaging material comprises a layer of barrier material defined, for example, by an aluminium film, which is superimposed on a layer of heat-seal plastic material and is in turn coated with another layer of heat-seal plastic material defining the inner face of the package contacting the food product.

Aseptic packages are produced by unwinding the strip of packaging material in steps off a reel and through a sterilizing unit, where it is sterilized, for example, by immersion in a chamber of liquid sterilizing agent such as a concentrated solution of hydrogen peroxide and water.

The strip is then fed into an aseptic chamber where the sterilizing agent is evaporated by heating; and the strip is then folded into a cylinder and sealed longitudinally to form, in known manner, a continuous vertical longitudinally sealed tube. That is, the tube of packaging material forms an extension of the aseptic chamber, and is filled continuously with the pourable food product and fed to a forming and (transverse) sealing unit for forming the individual packages, and which grips the tube between pairs of jaws for transversely sealing the tube into pillow packs.

The pillow packs are separated by cutting the sealing portion in between the packs, and are then transferred to a final folding station where they are folded mechanically into the final shape.

More specifically, the sterilizing unit referred to above comprises a chamber containing the sterilizing agent through which the strip is fed continuously. The sterilizing chamber conveniently comprises two parallel vertical branches connected to each other at the bottom to define a U-shaped path, the length of which depends on the traveling speed of the strip to allow enough time to process the packaging material. To effectively process the packaging material in a relatively short space of time, e.g. about seven seconds, and so reduce the size of the sterilizing chamber, the sterilizing agent must be maintained at a high temperature, e.g. of about 70° C. In known sterilizing units, this is normally achieved by forming the walls of the sterilizing chamber with a first gap, which is filled, in use, with water recirculated through a thermostatically controlled electric heater.

Whereas the packaging material is completely impermeable to the sterilizing agent on the polyethylene-coated faces of the strip, the layer of paper material is exposed along the edges of the strip and fairly absorbent; and what is known in the trade as "edge wicking" (edge absorption) is maintained within acceptable limits providing the strip is kept a limited length of time in the sterilizing chamber, as is the case when the machine is operating normally.

Should the machine, however, be arrested for any reason, the sterilizing chamber must be emptied immediately. Otherwise, the sterilizing agent penetrates the edges of the paper layer and, if the edge portion is penetrated to a width of a few millimeters, inevitably impairs subsequent longitudinal sealing of the strip to form the tube of packaging material as described above.

Following stoppage, and particularly when restarting the machine after a short stoppage, edge wicking tends to occur anyway on known machines, despite the sterilizing chamber being emptied.

In-depth research into the phenomenon has revealed several causes:

- the porosity of the paper material: for production cost reasons, this can only be reduced to a certain extent;
- hydrostatic pressure : this is also difficult to reduce, in that, being dependent on the necessary processing time, the height of the U-shaped sterilizing chamber can only be reduced by altering the structure of the sterilizing unit, which obviously involves complications in terms of the system as a whole; and
- the temperature of the sterilizing chamber during stoppage, and of the sterilizing agent when fed back into the chamber. In particular, edge wicking has been found to be seriously affected by any difference, even of only a few degrees, between the temperature inside the chamber during stoppage and the temperature of the sterilizing agent fed back into the chamber. In known machines, such a difference in temperature is caused by the temperature of the chamber tending to rise once the chamber is emptied during stoppage, on account of the inevitable delay in the thermostat responding to the reduction in thermal absorption when the chamber is emptied. As a result, the temperature inside the chamber typically increases to at least 80° C., so that the sterilizing agent remaining on the walls of the chamber and in the paper material tends to evaporate, thus producing saturated vapour inside the chamber so that the pores of the paper material contain a saturated air/vapour mixture.

When the liquid sterilizing agent is fed back in at a lower temperature (due to dissipation, the temperature of the liquid fed back into the chamber is at best a few degrees lower than the liquid inside the chamber when the machine was arrested), the temperature of the strip and therefore of the air-vapour mixture inside the pores is reduced: the effect of this reduction is practically negligible as regards the air, which undergoes a reduction in volume of only a few percent, but is considerably more serious as regards the vapour, which condenses to assume, in the liquid state, a much smaller volume. This drastic reduction in volume produces a strong "suction" effect, which draws the sterilizing agent into the pores of the paper material, and which is the main cause of the edge wicking phenomenon.

By way of a solution to the problem, which is less serious during prolonged stoppages, due to evaporation of the residual liquid and a reduction in relative humidity inside the chamber, sterilizing units have been devised in which, before being fed into the sterilizing chamber, the sterilizing agent is heated by circulating it inside a second gap located outside the walls of the sterilizing chamber and enabling heat exchange with the water inside the first gap.

Use is also made of an auxiliary heat exchanger using cold water from the mains as coolant to cool the water controlling the temperature of the sterilizing chamber before starting the machine, i.e. before feeding the sterilizing agent into the chamber. As the water, however, can only be cooled after preheating the sterilizing agent, which is preheated using the same water as heating fluid, restarting the machine takes a fairly long time, typically as long as 7–8 minutes, which in some cases is even longer than the actual downtime of the machine.

In view of the extremely high output rate of packaging machines, such holdups result in considerable cost in terms of lost production.

SUMMARY OF THE INVENTION

It is an object of the present invention to provide a unit for sterilizing strip packaging material for a pourable food product packaging machine, designed to eliminate the aforementioned drawbacks typically associated with known machines.

According to the present invention, there is provided a sterilizing unit as claimed in claim 1.

BRIEF DESCRIPTION OF THE DRAWINGS

Two preferred non-limiting embodiments of the present invention will be described by way of example with reference to the accompanying drawings, in which.

DETAILED DESCRIPTION OF THE INVENTION

Figure 1:
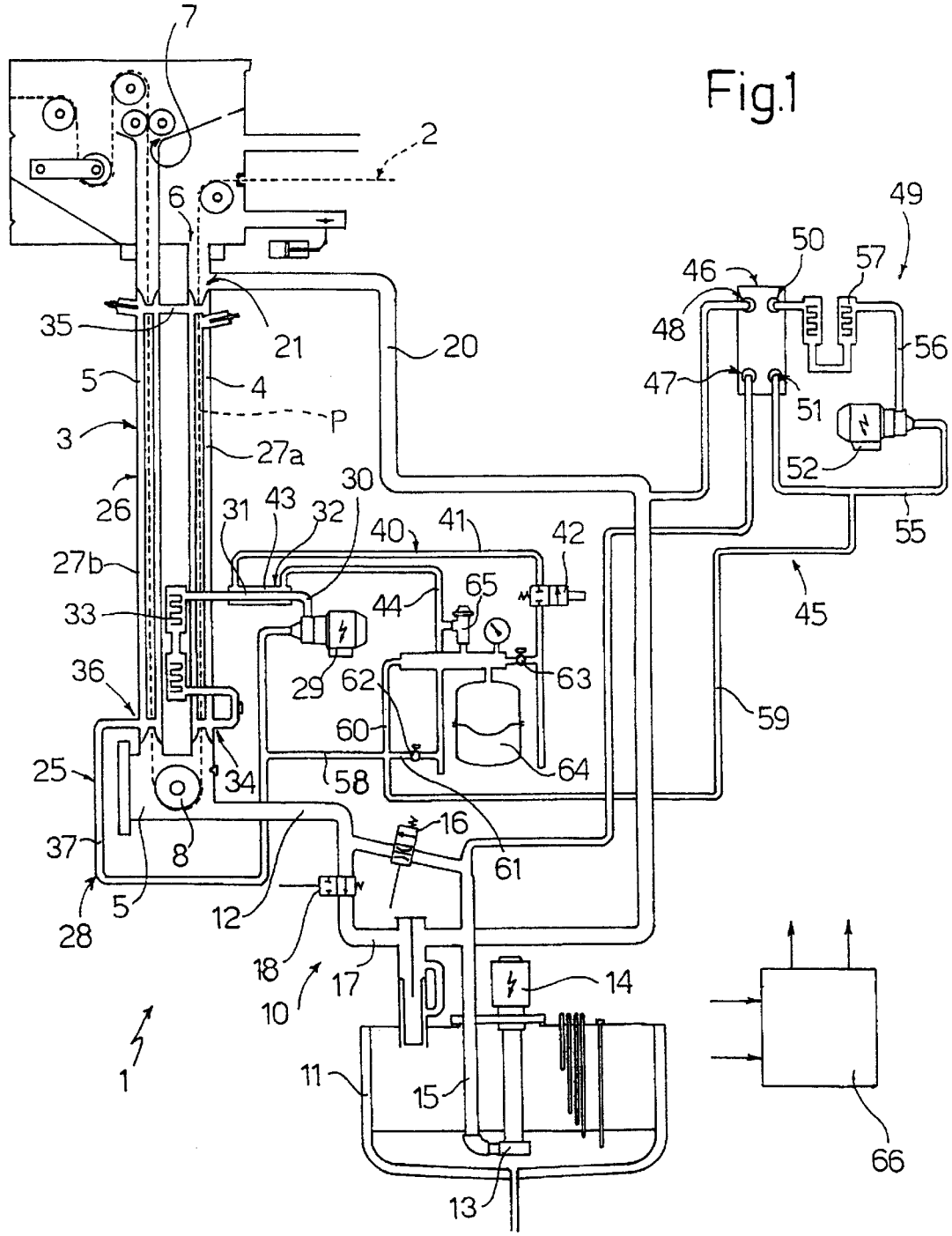
FIG. 1 shows a circuit diagram of a first embodiment of the invention.

Number 1 in FIG. 1 indicates as a whole a sterilizing unit for sterilizing a strip 2 of packaging material for a pourable food product packaging machine. Strip 2 is fed to unit 1 off a reel in known manner not shown.

Unit 1 substantially comprises a U-shaped sterilizing chamber 3, or bath, for containing a liquid sterilizing agent, e.g. a 30% solution of hydrogen peroxide ($H_2O_2$) and water (hereinafter referred to simply as "the peroxide"). Chamber 3 is defined by a vertical inlet conduit 4 and a vertical outlet conduit 5 having respective top openings 6 and 7 and connected to each other at the bottom by a bottom portion 5 of chamber 3 housing a horizontal-axis transmission roller 8. Strip 2 therefore defines, inside chamber 3, a U-shaped path P, the length of which depends on the traveling speed of the strip to ensure the packaging material is kept long enough in the peroxide.

Sterilizing chamber 3 forms part of a peroxide control circuit 10, which also comprises a peroxide collecting tank 11; a conduit 12 by which to fill/empty chamber 3; a pump 13 immersed in tank 11 and driven by an electric motor 14; a delivery conduit 15 connecting the delivery side of pump 13 to conduit 12 via a valve 16; and a drain pipe 17 connecting conduit 12 to tank 11 via a two-way, two-position, normally-open valve 18 for safety reasons (chamber 3 is emptied in the event of an electric system fault).

Valve 16 is preferably a two-way, two-position, normally-open type, but with an on/off member (not shown) allowing residual leakage in the closed position, as explained later on. For which purpose, a commercial valve may be used, and a hole of appropriate size formed in the on/off member.

Peroxide circuit 10 also comprises a recirculating conduit 20 connected to tank 11, and which communicates with an overflow 21 formed in the top portion of inlet conduit 4 of chamber 3 to determine the maximum level of peroxide in chamber 3.

Unit 1 also comprises a system 25 for controlling the temperature of the peroxide in chamber 3. In the FIG. 1 embodiment, system 25 is hydraulic, and comprises a heat exchanger 26 using hot water as the operating fluid by which to exchange heat with the peroxide. One phase of exchanger 26 is defined by chamber 3 itself, and the other phase comprises two gaps 27*a*, 27*b* formed in the walls of conduits 4 and 5 of chamber 3, and which are associated with a hydraulic circuit 28 for controlling the temperature of chamber 3.

More specifically, circuit 28 comprises a pump 29 having a delivery conduit 30 to which are connected, in series with each other, a phase 31 of a cooling heat exchanger 32, as explained later on, and an electric resistor heater 33, the output of which is in turn connected to the bottom inlet 34 of gap 27*a*. Gaps 27*a* and 27*b* are connected to each other at the respective top ends by a conduit 35.

Pump 29 also has an intake conduit 37 connected to the bottom outlet 36 of gap 27*b*.

Circuit 28 is associated with a cooling circuit 40 using cold water from the mains as the operating fluid. Circuit 40 comprises an inlet conduit 41 connected, via a two-way, two-position, normally-closed on/off valve 42, to a second phase 43 of exchanger 32, flowing in the opposite direction to phase 31; and the outlet of second phase 43 of exchanger 32 is connected to a water drain conduit 44.

According to the present invention, unit 1 also comprises a peroxide preheating system 45.

System 45 substantially comprises a countercurrent heat exchanger 46 using water as the operating fluid. More specifically, exchanger 46 has a peroxide inlet 47 connected to the delivery conduit 15 of pump 13; a peroxide outlet 48 connected to recirculating conduit 20; and a water phase connected in series with a heating circuit 49 and having an inlet 50 and an outlet 51.

Circuit 49 substantially comprises a circulating pump 52, in turn comprising an intake conduit 55 connected to outlet 51 of heat exchanger 46, and a delivery conduit 56 connected to an electric resistor heater 57 in turn connected at the output to inlet 50 of exchanger 46.

Intake conduits 37, 55 of respective pumps 29, 52 are connected by respective conduits 58, 59 to a filler conduit 60 and to a bleed conduit 61, which are in turn connectable to the water mains by respective taps 62, 63; and branch connected to filler conduit 60 are a water/compressed air accumulator 64 for pressure compensating circuits 28, 49, and a maximum-pressure valve 65 connected at the discharge to drain conduit 44.

Pumps 13, 29, 52, valves 16, 18, 42 and the resistors of electric heaters 33, 57 are controlled by a control unit 66 in response to input signals Si received from process sensors comprising, in particular, a sensor for detecting the temperature of the water in gap 27*b*, a sensor for detecting the temperature of the peroxide in chamber 3, and a sensor for detecting the temperature of the peroxide in tank 11.

Unit 1 operates as follows.

When cold starting, chamber 3 is empty, all the peroxide is contained in tank 11, and pump 13 is energized to feed a large amount of peroxide, e.g. about 50 l/min, through heat exchanger 46.

Filler valve 16 is closed, but, as already stated, allows a small amount of leakage (a few l/min) to conduit 12, and drain valve 18 is open, so that chamber 3 is not filled until the best cycle-start conditions are achieved, pending which, pumps 29 and 52 circulate water through respective heaters 33, 57. The cycle-start conditions are, for example, 72° C. for the water in circuit 28, and 75° C. for the peroxide in tank 11 (fill temperature). In this case, the water temperature is kept fairly high, since, chamber 3 and strip 2 being dry, there is substantially no risk of edge wicking, whereas it is important to prevent an undesired first-fill fall in temperature of the peroxide due to heat loss in the as yet cold pipes.

At the start of the cycle, valve 16 is opened and valve 18 closed, so that chamber 3 is filled rapidly with peroxide, and valve 16 is again closed once the chamber is filled.

During normal operation of the machine, the temperature of the peroxide is maintained at a minimum of 73° C. both in chamber 3 and tank 11; and, in the event either of the above temperatures falls below the predetermined threshold, a heating cycle is activated by circuit 28 and circuit 49 respectively.

Pump 13 operates constantly to maintain a continuous flow through exchanger 46 (heater 57, however, is normally off at this stage) and a continuous leakage of peroxide—conveniently a few liters a minute—through valve 16 to compensate for any peroxide losses in chamber 3 caused by outfeed of the wet strip 2, and also to keep pipe 12 and the bottom of chamber 3 hot. Any surplus peroxide flows out of chamber 3 through overflow 21 and back into tank 11 along recirculating conduit 20. Also pumps 29 and 52 operate constantly. The temperature of the peroxide in chamber 3 is controlled in conventional manner by circuit 28. If the temperature in chamber 3 falls below the threshold value, heater 33 is activated to heat the water in gaps 27*a*, 27*b* and so "actively lag" chamber 3. At this stage, valve 42 of cooling circuit 40 is kept closed.

If the temperature in tank 11 falls below the threshold value, heater 57 is activated.

In the event the machine is arrested, control unit 66 opens valve 18 to rapidly empty chamber 3.

At this point, a cooling cycle to cool chamber 3 to less than the operating temperature (e.g. 63° C.) and a heating cycle to heat the peroxide to the fill temperature (e.g. 75° C.) are commenced simultaneously. Chamber 3 is cooled by deactivating heater 33 and activating cooling circuit 40 by opening valve 42; and the peroxide is heated by activating heater 57.

The above conditions are achieved rapidly, normally in less than a minute, by virtue of the simultaneous action of circuits 40 and 49, and ensure edge wicking is maintained within acceptable limits when the machine is started again.

That is, cooling chamber 3 and preheating the peroxide to a higher temperature prevent the vapour inside chamber 3 from condensing when chamber 3 is filled again. Even after a short stoppage, during which chamber 3 is undoubtedly saturated, the machine may be restarted rapidly.

Figure 2:
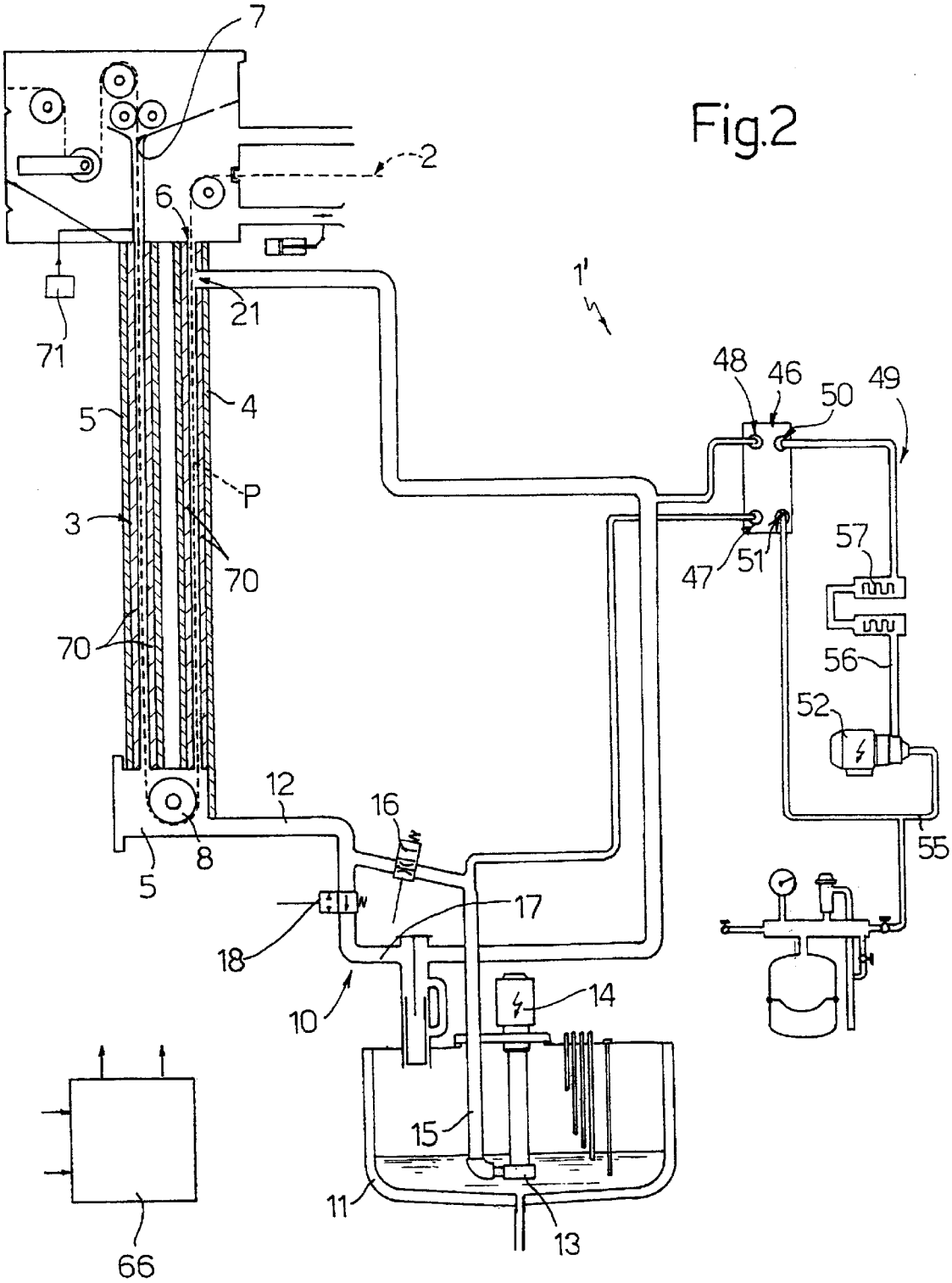
FIG. 2 shows a circuit diagram of a second embodiment of the invention.

FIG. 2 shows a further embodiment of a sterilizing unit in accordance with the present invention and indicated as a whole by 1'. In the following description, unit 1' is only described insofar as it differs from unit 1, and using the same numbering system for any parts identical or corresponding to those already described.

Unit 1' differs from unit 1 by system 25 for controlling the temperature in chamber 3 being electric as opposed to hydraulic. More specifically, in place of gaps 27*a*, 27*b*, chamber 3 is surrounded by four electric heaters 70 controlled by unit 66 and fitted externally in pairs to the walls of respective conduits 4, 5.

In the event the machine is arrested, chamber 3 is cooled by deactivating heaters 70 and blowing into chamber 3, by means of a forced ventilation circuit 71 (shown schematically in FIG. 2), sterile air at a lower temperature than chamber 3.

Alternatively, if heat dispersion through the walls of conduits 4, 5 is sufficient, chamber 3 may be cooled by simply deactivating electric heaters 70.

Clearly, changes may be made to units 1, 1' as described and illustrated herein without, however, departing from the scope of the accompanying claims.

What is claimed is:

1. A unit for sterilizing strip packaging material for a pourable food product packaging machine, comprising:

a sterilizing chamber for containing a liquid sterilizing agent, and along which said packaging material is fed;

a control circuit for controlling said sterilizing agent, and in turn comprising a collecting tank, input means for feeding said sterilizing agent from said tank to said chamber, and drain means for draining said sterilizing agent from said chamber into said tank;

control means for controlling the temperature in said chamber; and preheating means for preheating said sterilizing agent in said tank, and which may be activated prior to feeding said sterilizing agent from said tank into said chamber;

wherein said preheating means for preheating said sterilizing agent may be activated independently of said control means for controlling the temperature in said chamber to bring said sterilizing agent to a temperature at least equal to that of said chamber before the sterilizing agent is fed into the chamber.

2. The unit as claimed in claim 1, wherein said preheating means comprises first heat exchange means with a first auxiliary operating fluid; and a control circuit for controlling the temperature of said first auxiliary operating fluid.

3. The unit as claimed in claim 1, wherein said control circuit for controlling the temperature of said first auxiliary operating fluid comprises electric heating means and a circulating pump.

4. The unit as claimed in claim 1, wherein said input means for feeding said sterilizing agent from said tank into said chamber comprises a pump; and a first valve for controlling flow from said pump to said chamber.

5. The unit as claimed in claim 4, wherein said first valve is a two-way, two-position valve permitting continuous leakage in a closed position.

6. The unit as claimed in claim 1, wherein said drain means for draining said sterilizing agent from said chamber into said tank comprises a drain conduit interposed between said chamber and said tank; and an on/off second valve along said drain conduit.

7. The unit as claimed in claim 1, wherein said control means for controlling the temperature in said chamber comprises second heat exchange means with a second auxiliary operating fluid; and a control circuit for controlling the temperature of said second auxiliary operating fluid.

8. The unit as claimed in claim 7, wherein said second heat exchange means comprises at least one gap formed about said chamber.

9. The unit as claimed in claim 8, wherein said control circuit for controlling the temperature of said second auxiliary operating fluid comprises electric heating means.

10. The unit as claimed in claim 7, wherein said control means for controlling the temperature in said chamber comprises cooling means for cooling said second auxiliary operating fluid.

11. The unit as claimed in claim 10, wherein said cooling means for cooling said second auxiliary operating fluid comprises heat exchange means for exchanging heat between said second auxiliary operating fluid and a third auxiliary operating fluid.

12. The unit as claimed in claim 11, wherein said first, second and third auxiliary operating fluids are water.

13. The unit as claimed in claim 1, wherein said control means for controlling the temperature in said chamber comprises electric heating means surrounding said chamber.

14. The unit as claimed in claim 13, wherein said control means for controlling the temperature in said chamber comprises forced ventilation means for feeding into said chamber sterile air at a lower temperature than the chamber.

15. The unit as claimed claim 1, wherein said preheating means and said control means for controlling the temperature in said chamber are activated simultaneously.

16. A method for sterilizing packaging material, comprising the steps of:

preheating a sterilizing agent in a collection tank to a desired temperature;

feeding the sterilizing agent into a sterilizing chamber;

feeding the packaging material into the sterilizing chamber;

maintaining a temperature of the sterilizing chamber by way of a control circuit which operates independently of the temperature of the sterilizing agent, wherein the temperature of the sterilizing agent is brought to the temperature of the sterilizing chamber prior to said step of feeding the sterilizing agent to the sterilizing chamber.

17. The method of claim 16, further comprising the step of:

cooling the sterilizing chamber, while at the same time, preheating the sterilizing agent prior to feeding the sterilizing agent into the sterilizing chamber.

18. A method of preventing absorption of a sterilizing agent on a strip of packaging material in case of a machine stoppage, comprising the steps of:

feeding the packaging material into a sterilizing chamber containing the sterilizing agent;

upon stoppage of the machine, emptying the sterilizing chamber; and cooling the sterilizing chamber, while at the same time, preheating the sterilizing agent prior to feeding the sterilizing agent into the sterilizing chamber.

* * * * *